US006082448A

United States Patent [19]

Haussmann

[11] Patent Number: 6,082,448

[45] Date of Patent: Jul. 4, 2000

[54] COLLECTOR FOR A MOTOR VEHICLE HEAT EXCHANGER WITH A PARTITIONING MADE OF CROSSING FLAT STRIPS

[75] Inventor: Roland Haussmann, Wiesloch, Germany

[73] Assignee: Valeo Klimatechnik GmbH & Co, KG, Hockenheim, Germany

[21] Appl. No.: 09/214,541

[22] PCT Filed: May 5, 1998

[86] PCT No.: PCT/EP98/02635

§ 371 Date: Feb. 9, 1999

§ 102(e) Date: Feb. 9, 1999

[87] PCT Pub. No.: WO98/50747

PCT Pub. Date: Nov. 12, 1998

[30] Foreign Application Priority Data

May 7, 1997 [DE] Germany ..... 197 19 254

[51] Int. Cl.[7] ..... F28F 9/04

[52] U.S. Cl. ..... 165/174; 165/158; 165/176; 165/906

[58] Field of Search ..... 165/174, 176, 165/158, 906

[56] References Cited

U.S. PATENT DOCUMENTS

| | | | |
|---|---|---|---|
| 2,044,455 | 6/1936 | Witzel | 165/174 X |
| 2,099,186 | 11/1937 | Anderegg | 165/174 X |
| 2,596,233 | 5/1952 | Gardner | 165/158 X |
| 2,715,516 | 8/1955 | Reinold et al. | 165/158 X |
| 3,191,674 | 6/1965 | Richardson | 165/158 |
| 4,497,363 | 2/1985 | Heronemus | 165/174 X |
| 4,972,903 | 11/1990 | Kwok et al. | 165/158 |
| 5,168,925 | 12/1992 | Suzumura et al. | 165/176 |
| 5,203,407 | 4/1993 | Nagasaka | 165/174 |
| 5,479,985 | 1/1996 | Yamamoto et al. | 165/176 |

FOREIGN PATENT DOCUMENTS

| | | | |
|---|---|---|---|
| 0 745 822 | 12/1996 | European Pat. Off. . | |
| 1183177 | 7/1959 | France | 165/158 |
| 21 61 279 | 4/1973 | Germany . | |
| 25 02 291 | 7/1976 | Germany . | |
| 31 32 078 | 3/1982 | Germany . | |
| 195 15 526 | 5/1996 | Germany . | |
| 28476 | 2/1980 | Japan | 165/176 |
| 286992 | 12/1991 | Japan | 165/176 |
| 353397 | 12/1992 | Japan | 165/176 |
| 1896 | 1/1993 | Japan | 165/176 |
| 309106 | 4/1929 | United Kingdom | 165/158 |
| 2095389 | 9/1982 | United Kingdom | 165/158 |

*Primary Examiner*—Leonard Leo
*Attorney, Agent, or Firm*—Morgan & Finnegan, LLP

[57] ABSTRACT

The invention relates to a header of a heat exchanger for motor vehicles with an at least two-part design of the header of a tube bottom and a cap, which together form, optionally with at least one further component, the housing of the header. According to the invention, it is intended that the cap and/or the tube bottom together with the respective housing wall extending around is an integral diecast part.

32 Claims, 4 Drawing Sheets

COLLECTOR FOR A MOTOR VEHICLE HEAT EXCHANGER WITH A PARTITIONING MADE OF CROSSING FLAT STRIPS

BACKGROUND OF THE INVENTION

The invention relates to a collector or header of a heat exchanger according to the preamble of claim 1.

The term header generally not only means an intermediate header or a header on the outlet side, but also a distributor on the inlet side.

Many of such multipart headers are known. In the past, for such a header one has generally made a cap, a tube bottom or a compartment subdivision of sheet metal or a plate-like material, caps having been deep-drawn for example of sheet metal. For special purpose constructions, injection moulded parts have already been used in the past. For example an evaporator, which is in particular also to be employed in motor vehicle air conditioning equipment, for a distributor a sandwich construction of injection moulded plates has been employed according to the DE-31 50 187 C2, in which the chambers required in a distributor have been obtained by corresponding groove formations.

In the following, instead of the term injection moulding the term diecast will be used in the description of the invention, the terms diecast and injection moulding being, however, considered to be synonyms within the scope of the invention.

It is already known per se to make the cap and the tube bottom of a header or a comparable structural part, such as a refrigerant distributor (DE-A1-42 12 721), each by diecasting. The diecast materials on aluminum basis used in most cases, however, cannot be soldered nor brazed due to their high portion of silicon in aluminum alloys. Therefore, in such cases one has assembled the header or a similar structural component by using inserted seals. This requires an additional constructional effort and restricts the permanent closeness.

The inset of the refrigerant distributor of the DE-A1-42 12 721 is not made as a diecast part but as an extruded piece (column 4, lines 1–3). Extruded pieces on an aluminum basis have always been able to be brazed due to the composition of their aluminum alloys different from that of diecast parts.

BRIEF SUMMARY OF THE INVENTION

The object underlying the invention is to further take advantage of the possibilities of the diecast manufacture for headers in motor vehicle heat exchangers than has been taken into account in the past.

That is, by means of an appropriate selection of the material for the inset the invention makes possible in an advantageous manner a combination of the following two aspects which has not been taken into consideration in the past:

On one hand, the inset is included in the soldering, preferably brazing, of the complete header.

On the other hand, the possibilities of making the form or design of the header by producing the header of diecast are taken advantage of.

Especially preferred is the use of the alloy according to claim 20 newly developed for the manufacture as a solderable or brazable diecast part.

That is, within the scope of the invention the following three aspects are in addition particularly taken advantage of:

First aspect: The diecast manufacture is not restricted only to a plate construction, but can also be employed for the manufacture of tank-like bodies with a bottom and a side wall extending therearound. Such a side wall extending around is not given from the beginning in the known plate construction.

Second aspect: The diecast technique makes it also possible to manufacture filigree flat web grids which have been manufactured in the past in a complicated assembly construction of cut out sheet metal strips (cf. DE 195 15 526 C1, FIG. 11).

Third aspect: In evaporators, in which the header serves as a distributor on the inlet side, it is even possible to design separate supply lines to different inlet chambers provided for a uniform distribution to continued ducts together with the connection openings between the supply lines and the respectively assigned inlet chamber in the diecast technique within the corresponding chamber subdivision, whereby in an integral fabrication of the chamber subdivision with the cap of the evaporator, a separate cover in the cap of an arbitrary structure is to be provided above the supply lines. This in particular creates the possibility not given in the past to take advantage of a region for the arrangement of the supply lines within a cross-section longitudinal of the distributor, which is no longer restricted by the space requirement of the inlet chamber on the inlet side.

The invention gives emphasis to one of the three above-mentioned aspects and incorporates the two remaining further aspects into the invention as further developments.

From the DE-31 36 374 C2, it is already known per se to integrate a body intended as an inset into a connection case of a distributor, which, in view of its manner of construction, can possibly also be made by injection moulding, which body itself can be finished by cutting or as an injection moulded part and combines various supply lines to individual inlet chambers. This, however, does not mean an integral fabrication of such supply lines having an injection moulded or diecast compartment subdivision.

As far as diecast or injection moulding, respectively, has been used in the past within the illustrated application fields for assembling a header, apart from the already mentioned seals adhesives have been mainly considered as connections. However, in contrast thereto, the invention provides, as illustrated, diecast parts for the inset and preferably also for the casing (cf. claim 12) the shaping of which corresponds in many aspects to that of pre-shaped sheet metal pieces. The invention furthermore considers to combine diecast parts with sheet metal pieces. In the present context, however, shaped sheet metal pieces have generally been soldered by brazing. This conventional kind of connection by soldering, preferably by brazing, is adopted within the scope of the invention by completely or partially including diecast parts, by using a solderable or brazable alloy as a material for the diecast part in question. In a combination with sheet metal pieces being solder- or braze-coated on at least one side, one can then even completely dispense with a corresponding solder or braze coating of the diecast part in question.

The pins according to claim 2 (with the further developments of claims 3 to 10 and 14) have—inter alia—the advantage that before soldering or brazing the header a mechanically adherent pre-assembly of cap and tube bottom of the header can be effected such that by doing this the solder or braze gap can remain minimal and correspondingly the security against leakage when soldering or brazing is maximal.

BRIEF DESCRIPTION OF THE DRAWINGS

The invention will be illustrated more in detail by means of schematic drawings and several embodiments as follows, wherein:

FIG. 5 shows a plan view on the tube bottom of a header according to FIG. 3 wherein the cap is put off, the compartment subdivision according to FIG. 4, however, is put on;

Figure 1:
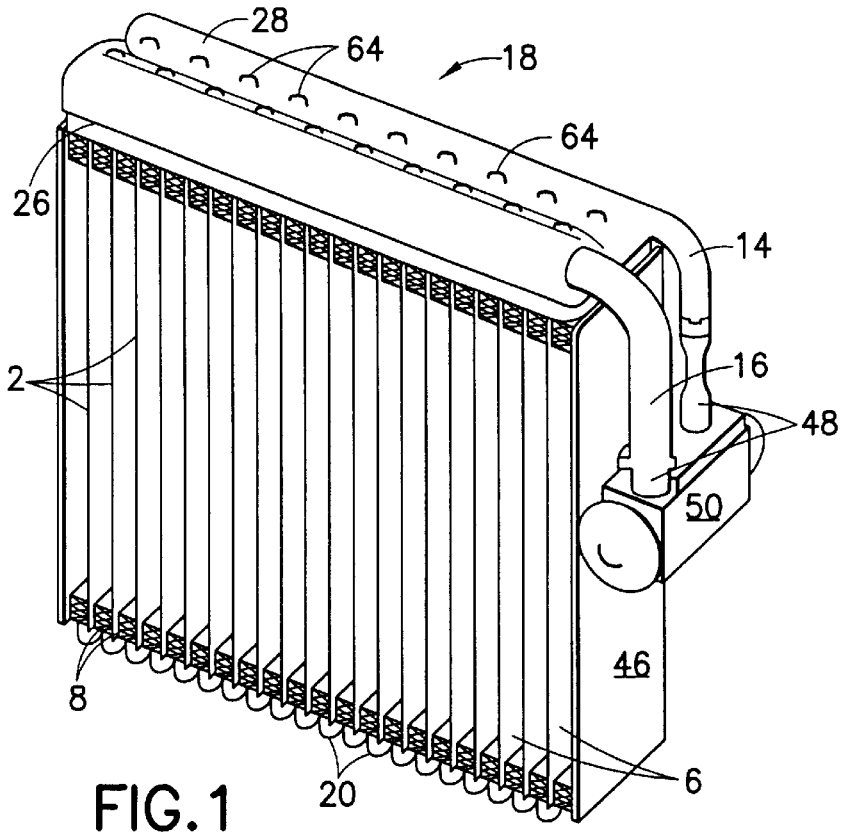
FIG. 1 shows a perspective outside view of a four-flow flat tube heat exchanger designed as an evaporator.

The flat tube heat exchanger represented in the figures has a four-flow design in all represented embodiments and is designed as an evaporator of a refrigerant circulation.

This does not exclude to transfer the gist of the represented features also to heat exchangers having a different number of flows, optionally also to heat exchangers not being designed with flat tubes and not serving as evaporators.

DETAILED DESCRIPTION OF DRAWINGS

The flat tube heat exchanger has the following general design:

A major number of typically twenty to thirty flat tubes 2 is arranged at constant distances to each other and with aligned front sides 4. Between the flat sides 6 of the flat tubes each, a zig zag fin 8 is internested in a sandwiched fashion. A zig zag fin 8 each is furthermore arranged at the two outer surfaces 4 of the outer flat tubes. Each flat tube comprises internal reinforcing webs 10, which division off chambers 12 in the flat tube acting as continuous ducts. Depending on the structural depth, a number of the chambers or ducts 12 of ten to thirty is typical.

The stated typical regions of the number of flat tubes and the chambers thereof are intended to be only a preferred number and are not intended to be restricting.

In a motor vehicle air conditioning equipment, in the final state outer air as an external heat exchange medium flows in the direction of the arrow shown in FIG. 1 in the direction of the structural depth through the block arrangement of the flat tubes 2 and the zig zag fins 8.

In the evaporator, a refrigerant, such as in particular fluorohydrocarbon, serves as internal heat exchange medium which enters the flat tube heat exchanger via a supply line 14 and exits the heat exchanger via an outlet line 16. In the refrigerant circulation, the supply line 14 comes from the liquefier thereof. The outlet line 16 leads to the condenser of the refrigerant circulation.

With an even number of flows in the heat exchanger, the distribution of the refrigerant on the inlet side is effected from the supply line 14 to the individual flat tubes by a so-called distributor. On the outlet side, the refrigerant is supplied as a whole to the outlet line 16. Though it is possible to assign the distribution and the collection to separate boxes or tanks, in all embodiments both functions are combined in a common header 18.

Figure 2:
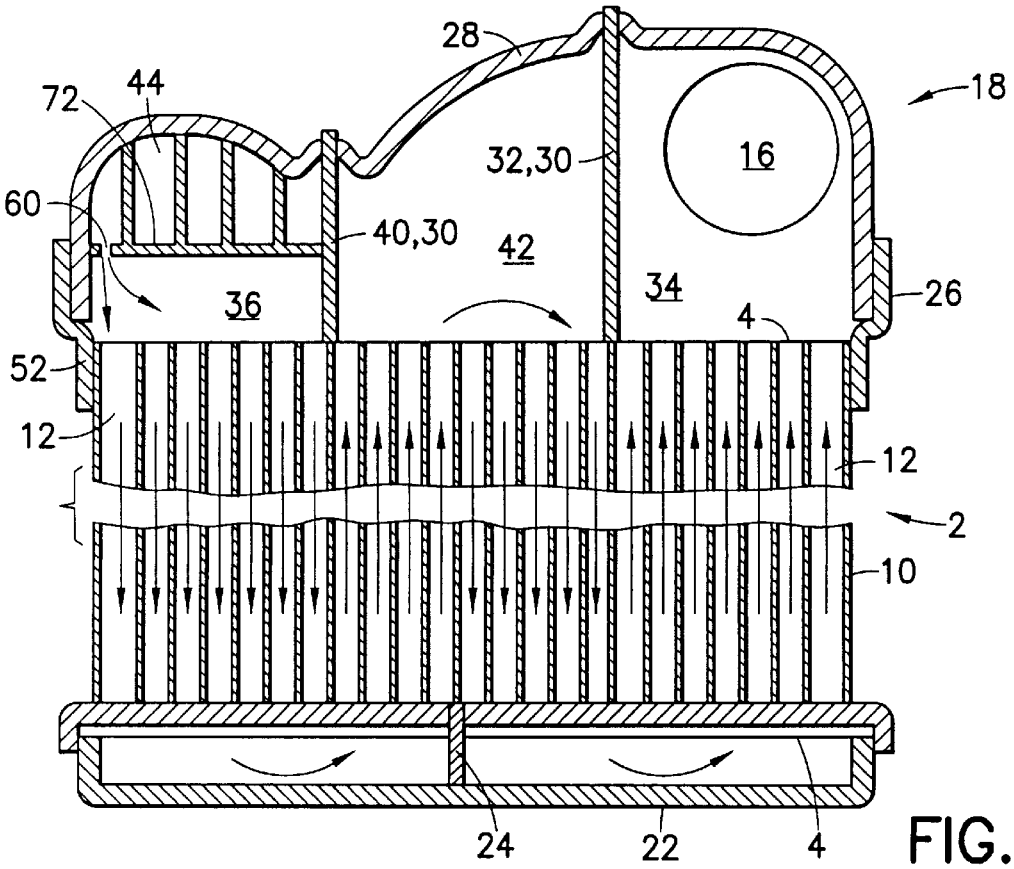
FIG. 2 shows a possible cross-section embodiment of the flat tube heat exchanger according to FIG. 1 with a first modification of the embodiment of the header.

This header 18 is then arranged at a front side 4 of the flat tubes 2, while at the other front side 4 of the flat tubes 2, a flow reverse takes place only between each of the flows, here for example by the individual bowls 20 illustrated in FIG. 1 or by integrating the reversing functions of such individual bowls in a common reversion header 22 (not shown) according to the illustrated representation in FIG. 2. The individual bowls 20 according to FIG. 1, too, can be integrated by links (not shown) to form a modular unit, if necessary.

In the borderline case of a single-flow heat exchanger, bowls 20 or the reversion header 22 would be replaced by an outlet header (not shown).

The multi-flow design means at least one flow reverse in the region of the individual ducts formed by the chambers 12 in each flat tube 2. In a double-flow design, the bowl 20 or the reversion header 22 does then not need any further intermediate chamber subdivision, it is only necessary that a single reversion function is guaranteed. In case of a multiple reversion, at least one parting wall is necessary, which is represented in the case of a four-flow design in FIG. 2, so that in this case of a four-flow design, a double simple reversion in the respective bowl 20 or in the reversion header 22 is effected. In a design with an even greater number of flows, the number of parting walls 24 optionally has to be increased.

The header 18 is basically composed of a tube bottom 26 and a cap 28, and optionally further parts for assembling the header 18 can be provided, which are at least partially stated in the following.

The free ends of the flat tubes 2 facing away from the bowls 20 or the reversion headers 22, respectively, tightly engage the tube bottom 26 in communication with the inner space of the header 18, which tube bottom is correspondingly provided with engaging slits as well as optionally with internal and/or external engaging muffs.

As in the header 18, the inlet function and the outlet function of the refrigerant are combined, the header 18 requires at least a two-chamber design which separates an inlet side from the outlet side. For this purpose, the chamber subdivision generally denoted with 30 comprises at least one flat web in form of a longitudinal web 32, which separates the inlet region in the header 18 communicating with the supply line 14 from an outlet chamber 34 continuously extending longitudinally of the header 18 and communicating with the outlet line 16.

In the evaporator, furthermore the supply of the refrigerant on the side of the inlet to all flat tubes 2 has to be as uniform as possible. In a borderline case, the supplied refrigerant can be supplied to each individual flat tube 2 separately by a so-called distributor. In most cases, however, the supply is effected to adjacent groups of flat tubes, in which at least some groups comprise a number of flat tubes higher than one, wherein the number of flat tubes per group can also vary. In the embodiment according to FIG. 5, the same number of two flat tubes per group is provided with a total number of ten flat tubes. An own inlet chamber 36 is assigned to each group of flat tubes, which chamber directly communicates with the respective group of the flat tubes. The inlet chambers 36 are divisioned off from one another in the chamber subdivision 30 by crosswise webs 38 designed as flat webs.

In a not shown double-flow evaporator, the crosswise webs 38 depart at a right angle only from one side of each of the longitudinal webs 32.

In the represented four-flow evaporator, apart from the longitudinal web 32 contiguous to the outlet chamber 34, another longitudinal web 40 in parallel to this web is provided. This web is intersected at a right angle by the crosswise webs divisioning off the inlet chambers 36 up to the connection to the longitudinal web 32. In the elongation of the crosswise webs 38 between the two longitudinal webs 32 and 40, between each of these longitudinal webs an inner reversion chamber 42 contiguous to the respective outer inlet chamber 36 for reversing the second flow into the third flow is divisioned off within the header 18.

In case of greater numbers of flows which are guided through the header 18 with a reversion function, the number of the longitudinal webs with the function of the longitudinal web 40 as well as the number of the inner reversion chambers 42 increase correspondingly, the reversion chambers then being furthermore internested in the crosswise direction of the header situated internally and one next to the other between the inlet chambers 36 as well as the outlet chamber 34.

The supply line 14 communicates with each of the individual inlet chambers 36 via an own supply line 44 extending in the header 18, which has various designs in the embodiments.

In most cases, in the assembled heat exchanger the block of flat tubes 2 and zig zag fins 8 is laterally terminated by a side sheet metal 46 in contact with each of the outer zig zag fins, such that the side sheet metals 46 form an outer frame for the outer air flowing against the heat exchanger block.

The flat tubes 2, the zig zag fins 8, the tube bottom 26 and the cap 28 of the header together with the optionally provided chamber subdivision 10 as well as the side sheet metals 46 of the heat exchanger consist, as well as conveniently the supply line 14 and the outlet line 16, of aluminum and/or an aluminum alloy and are brazed including the sections of the line connections adjacent to the flat tube heat exchanger to form the finished evaporator.

Without the invention being restricted thereto, in practice at least in refrigerant evaporators for motor vehicle air conditioning equipment's according to FIG. 1, the supply line 14 and the outlet line 16, which can pass over into the header 18 via corresponding connecting sleeves, are connected to two respective connecting sleeves 48 of a thermostatically controlled block valve 50. At the opposite side which is not visible, this valve comprises two further connecting sleeves at the side of the inlet and of the outlet.

Figure 3:
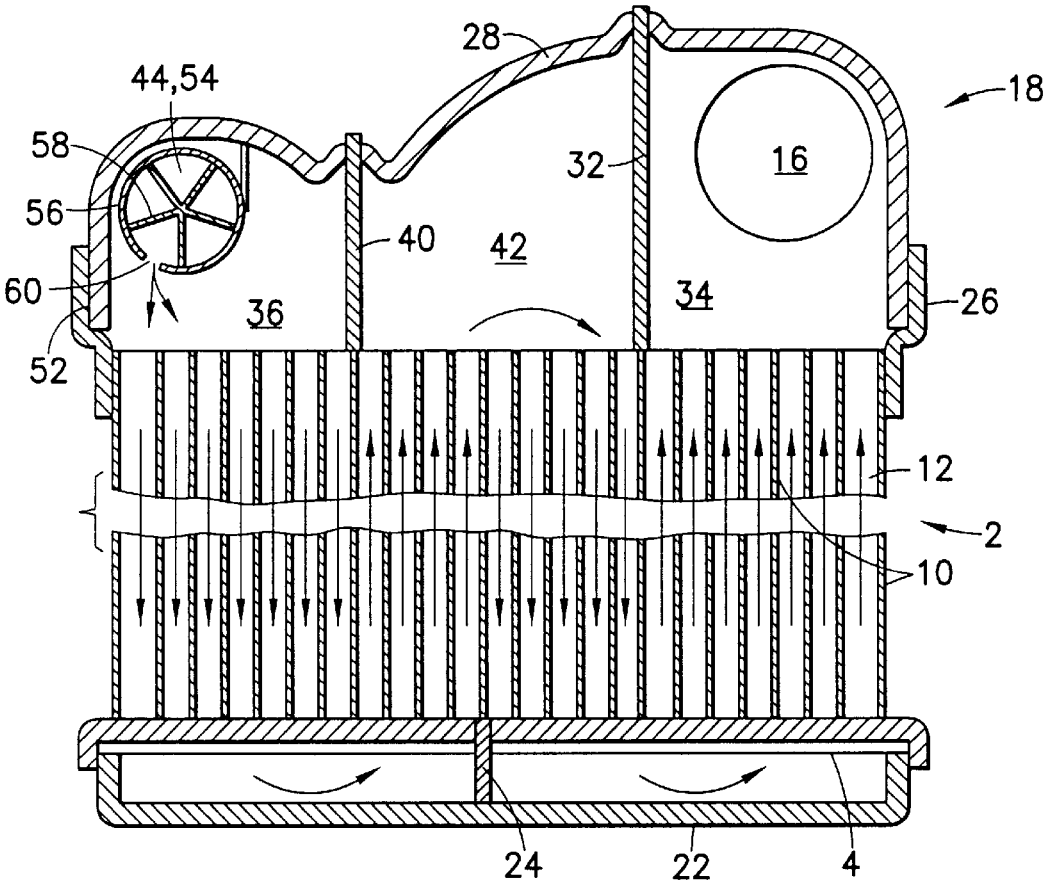
FIG. 3 shows a cross-section corresponding to FIG. 2, however, with a second modification of the embodiment of the header.
Figure 4:
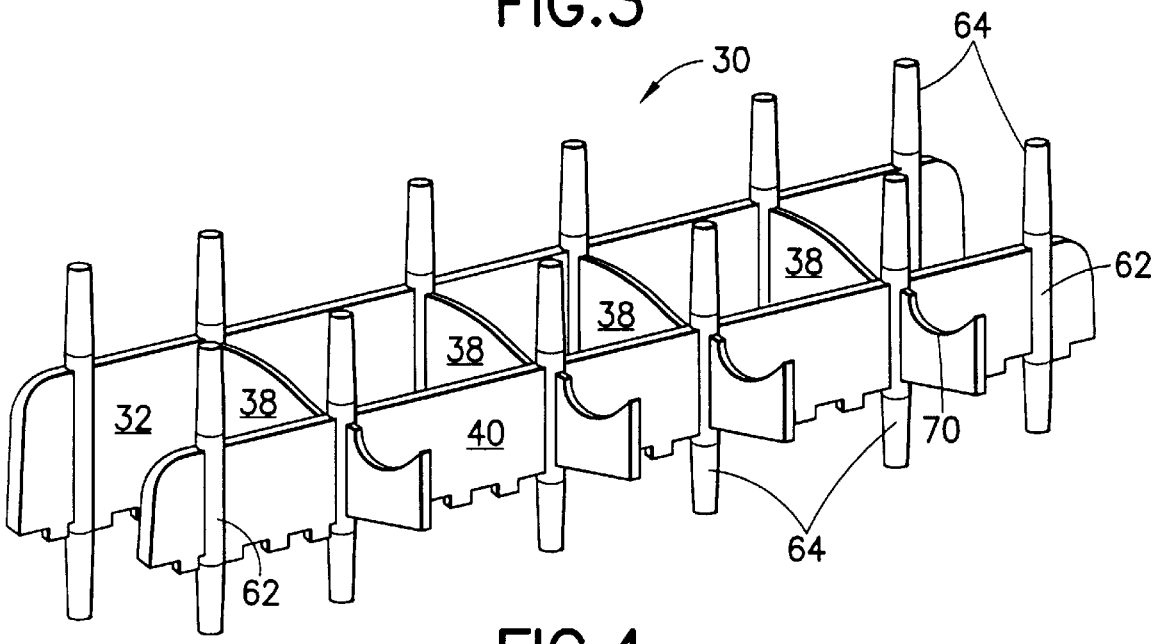
FIG. 4 shows a possible compartment subdivision of the header according to FIG. 3 made of diecast which can be inserted between the tube bottom and the cap thereof.

In the following, the various embodiments are considered more in detail:

First of all in the embodiment of the matching FIGS. 3 and 4, the tube bottom 26 and the cap 28 are formed of sheet metal pre-coated with solder or braze. The free edge of the cap here engages with an overlap on at least one side—in FIG. 3 a two-sided overlap 52 is presented—the tube bottom 26.

According to FIG. 3, the own supply lines 44 of the inlet chambers 36 are integrated in a manifold pipe 54, which comprises a tube casing 56 and an internal star-shaped subdivision 58, the free segments of which form the own supply lines 44. In order to make possible that these own supply lines 44 join the pertaining inlet chamber 36 in each case at the same circumferential location of the tube casing 56, the star-shaped subdivision 58 has a helical or coil-shaped course, respectively. The respective own supply line 44 here communicates with the related inlet chamber 36 via an outlet opening 60 arranged in the tube casing 56 of the manifold 54. If required, the respective outlet openings 60 can also be designed for direct injection purposes into the inlet chambers in a throttle fashion and dimensioned, such that the pressure difference between the liquefying and evaporating pressure is essentially reduced to zero. In FIG. 3, an orientation of the outlet opening to the wall of the inlet chamber 36 is shown. The corresponding angle can be selected as required without a direct orientation towards the chambers 12 of the flat tubes 2 being excluded.

As can be seen more in detail from FIG. 4, the chamber subdivision 30 consists of the two longitudinal webs 32 and 40 as well as the crosswise webs 38 intersecting them on an integral diecast or injection moulded piece, the terms diecast and injection moulding being understood as synonyms within the scope of the invention.

The term intersecting flat webs of the chamber subdivision 30 is intended to also mean the borderline case of an intersection only on one side in the sense of the connection at a right angle of the crosswise webs 38 to the longitudinal web 32 only on one side, which, in case of a double-flow heat exchanger, forms the complete chamber subdivision 30.

For connecting the chamber subdivision 30 with the cap 28 as well as with the tube bottom 26, the links of the longitudinal webs 32 and 40 with the flat webs 38 are each provided with a columnar reinforcement 62, which pass over at both opposing sides of the chamber subdivision 30 into pins 64 tapering towards the outside and being in alignment on both sides of the chamber subdivision with themselves and with the columnar reinforcements 62. These pins 64 are integrally designed at the diecast part of the chamber subdivision 30 and serve as a connection with the tube bottom 26 as well as with the cap 28, in FIG. 3 a kind of connection being pictorialized, namely that of FIG. 6*c* described in the following.

Figure 5:
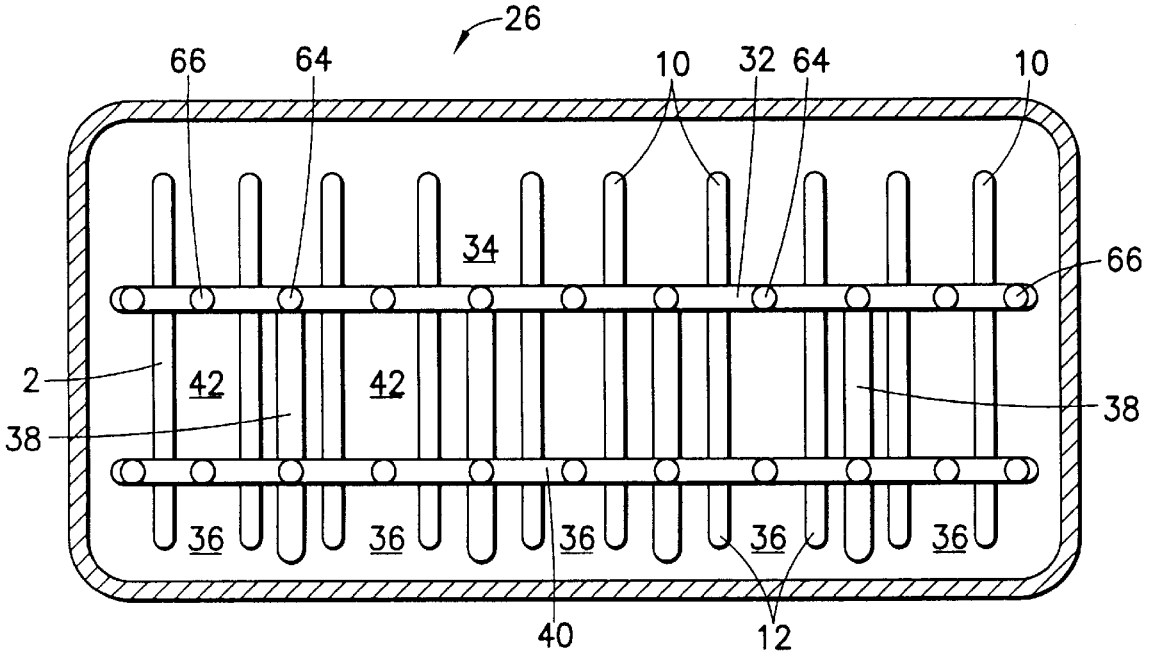

In FIG. 5, another alternative to the embodiment according to FIG. 4 is shown, wherein in addition to the pins 64 on both sides, supplementing pins 66 are designed on both sides between the pins 64, being steadily or uniformly inserted in a raster fashion, which pins 66 can optionally extend from columnar reinforcements 62 of the flat tubes, which are then not designed at intersection points of the flat webs.

As can further be seen in FIG. 5, the raster or pattern of the pins 64 and 66 is selected so as to be internested in the raster or pattern of the connecting points each of the flat tubes 2, so that neither mechanically a detrimental interaction of the pin connections of the chamber subdivision 30 with the tube bottom on one hand and of the flat tubes 2 with the tube bottom on the other hand occurs. An eccentric internesting is shown, which, however, can also be provided as a centric internesting.

FIGS. 6*a* to 6*d* show, without intended to be a concluding enumeration, four preferred kinds of connection of the pins with the sheet metal of the tube bottom 26 and/or the cap 28.

Figure 6A:
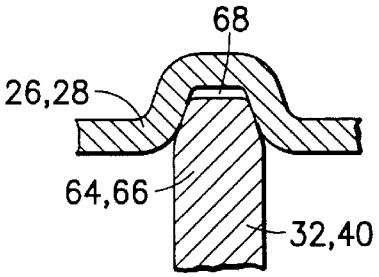
FIGS. 6*a* to 6*d* show detailed cross-sections of four alternatives of a connection each of the compartment subdivision according to FIG. 4 with the tube bottom or the cap of the evaporator according to FIG. 3.

In the alternative of FIG. 6*a*, the sheet metal only has to be indented bowl-like, the corresponding pin 64 or 66 then engaging the indentation 68 with its tapering end and being brazed at that location. This kind of connection would be an adoption of the kind of connection of the flat webs, that is in particular of the longitudinal webs 32 and 40, the chamber subdivision 30 with the cap 28 and/or the tube bottom 26.

Figure 6B:
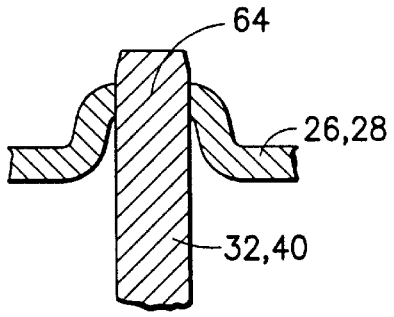
Figure 6C:
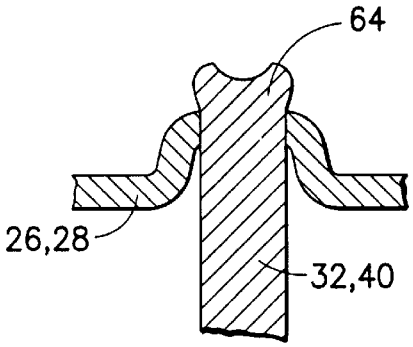
Figure 6D:
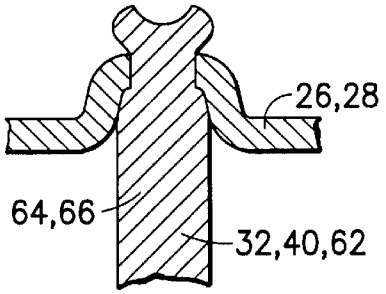

However, for increasing the stability, preferably the manners of fastening the pins 32 and 40 with the tube bottom and the cap according to FIGS. 6*b* to 6*d* are used, the connection of the flat webs with the tube bottom and the cap according to FIG. 6*a* being maintained, in which manners of fastening in each case a gripping through the sheet metal of the tube bottom or the cap, respectively, is effected by the pins. FIG. 6*b* shows a simple lead-through, which in turn is brazed. In FIG. 6*c*, according to FIG. 1 the pin lead through is headed at the outside, such that it forms an outer form-fitted undercutting lock. In the alternative according to FIG. 6*d*, in addition the pin having a constant thickness in the other embodiments, except for the conical bevel, is columnarily thickened such that at the inner side of the header 18, too, an undercut is effected, which effects a complete overgrip of the sheet metal of tube bottom and cap in connection with the heads (or headed portions) in the sense of FIG. 6*c*. In the embodiments according to FIGS. 6*b* to 6*d*, too, the bowl-like shaping of FIG. 6*a* is adopted, however, in addition a hole for gripping through is provided in this bowl-like shaping. This increases the dimensional stability of the sheet metal assembly.

In FIG. 4, furthermore one can see that in the region of the inlet chambers 36, the crosswise webs 38 each are provided with an approximately semicircular recess 70 at the top, in which the manifold 54 is inserted according to FIG. 3. In its embodiment of brazable aluminum or a corresponding aluminum alloy, the brazing of the manifold can be effected in the described manner together with the complete heat exchanger.

The alternative according to FIG. 2 is in accordance with the embodiment according to FIGS. 3 and 4, except for the manifold 54 and the recesses 70 adapted thereto being dispensed of. Instead, the own supply lines 44 to the individual inlet chambers 36 are in addition integrally designed in the diecast part in supplementation of this diecast part of the chamber subdivision 30.

As can be seen from FIG. 2, for this purpose the header 18 comprises two levels, seen in the extension direction of the flat tubes. In the lower level, all mentioned inlet chambers 36 into the groups of flat tubes are arranged. In the upper level, in addition the own supply lines 44 extend to the chambers 36. The design of this region, as well, in an integral diecast part is easily possible, as in the diecast part the inlet chambers 36 are still open to the longitudinal side of the header 18 and the own supply lines 44 are open on the side facing away from the flat tubes 2 and are separated from the inlet chambers 36 only by a parting wall 72 separating the two levels, in which parting wall the outlet openings 60 each are arranged, the dimensions of which are the same as explained with respect to the manifold 54.

It is appreciated that the own supply lines 44 of the inlet chambers 36 are commonly fed by the refrigerant on the side of the inlet in the upstream direction, as is also the case with respect to the manifold 54. Furthermore, the own supply lines 44 are terminated each at their ends, as also goes for the free end of the manifold 54.

Figure 7:
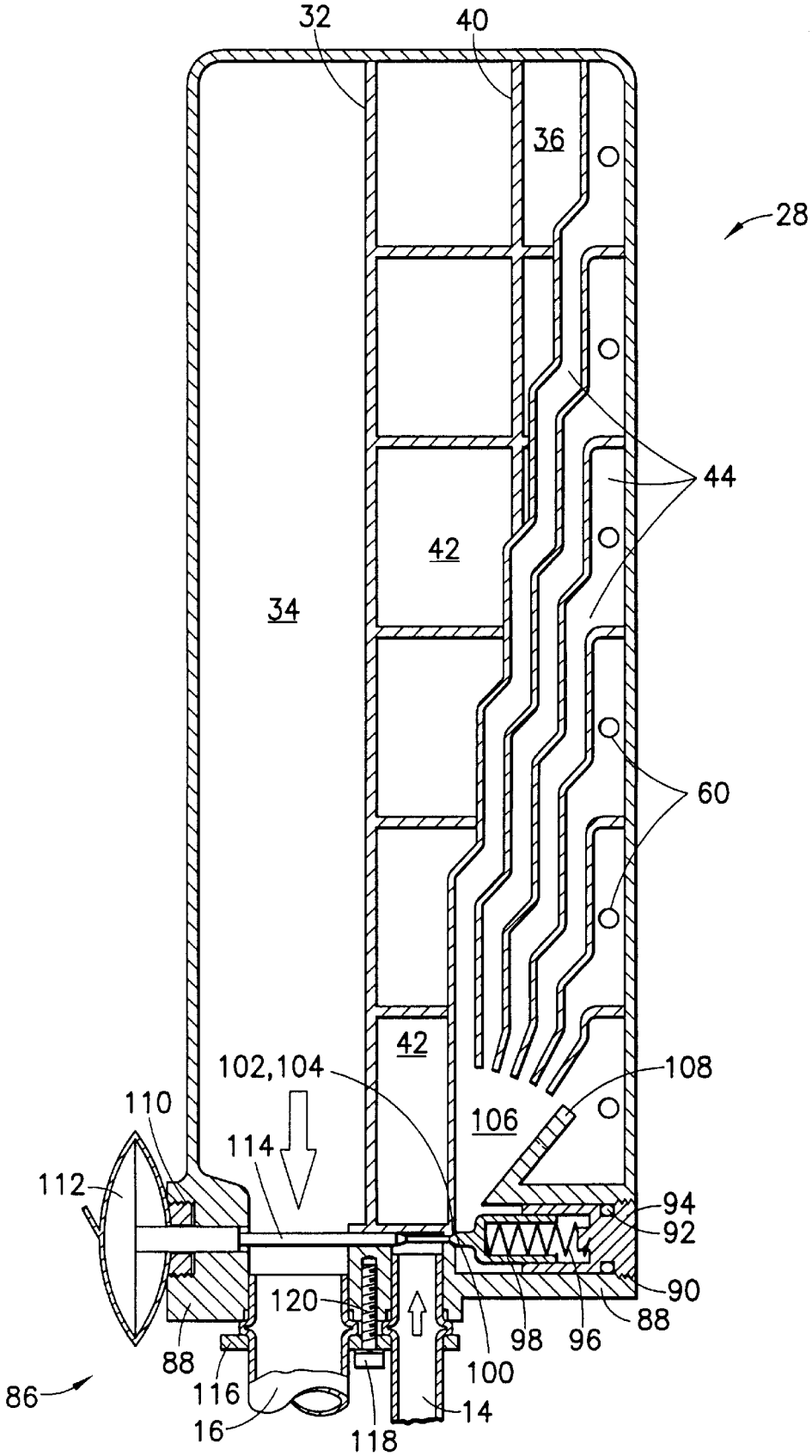
FIG. 7 shows a section longitudinal of a cap made as a diecast of a header on the side of the inlet.

In the formerly described embodiments of FIGS. 2 to 6*d*, at least the chamber subdivision and optionally the distributor device of the refrigerant on the side of the inlet for the distribution to the individual inlet chambers is integrated in a diecast part. This piece can principally be inserted as a separate part in a tube bottom 26 and cap 28 of the header 18 shaped of a sheet metal, the cap and the bottom together completely or to a major extent also forming the circumferential surface of the header 18. The cap and/or the tube bottom, however, can be in turn an integral diecast part each. This is described by means of FIG. 7 in the embodiment of which at least the cap 28 itself, which is solely considered in the following, is made of diecast. For reasons of an easier production, the tube bottom can here be conveniently shaped of solder or braze coated sheet metal as in the formerly described embodiments, however, as mentioned it can also be an integral diecast part in a manner not described in detail. The embodiment according to FIG. 7 is not to exclude the possibility described by means of FIGS. 1 to 6*b* to prepare the chamber subdivision 30 as an own diecast part which is inserted in a cap 28 also prepared separately by diecasting and which is optionally also placed upon a tube bottom 26 made by diecasting together with the cap 28.

Here, unlike in the formerly described embodiments, it is dispensable, if necessary, to form the chamber subdivision 30 and the own supply lines 44 to their inlet chambers 36 in a separate component. The chamber subdivision and the distributor device can rather be even completely integrated with the individual own supply lines 44 in the design of the cap, namely to a really high extent in the integral diecast part thereof.

Notwithstanding this possibility, the own supply lines 44 can be arranged according to FIG. 3 in a separate manifold 54 which is for example built into the header as an own component and for example according to FIG. 4 placed upon the semicircular recesses 70 of the chamber subdivision 30. Here, cap 28, tube bottom 26, chamber subdivision 30 and manifold 54 can be separate components.

In all embodiments of the invention, in which diecast parts are taken into account, one can do without these diecast parts themselves being solder coated, if the connection parts are designed with a solder or braze coating, such as for instance the supply line 14, the outlet line 16, the cap 28 in a sheet metal design as well as in a diecast part design, and, as already mentioned, the solder or braze coated sheet metal of the tube bottom.

An embodiment of the cap 28 as diecast part can be for example transferred to the alternative according to FIG. 2, where the own supply lines 44 are only arranged in the region of the inlet chambers 36 and can be integrated in the cap, if necessary. The own supply lines 44, however, can reach in a borderline case up to the longitudinal web 32 adjacent to the outlet chamber 34 being integrated in the diecast part of the cap 28, if necessary.

The supply line 14 and the outlet line 16 are arranged at the front side of the header 18 or the cap 28 thereof in the described embodiments, as in FIG. 1. Equally, an arrangement of at least the outlet line 16 can be provided at the longitudinal side of the header, preferably in the center thereof.

FIG. 7 shows an embodiment of the cap 28, in which the fluid distribution to the individual own supply lines 44 to the inlet chambers 36 are designed in a preferred manner.

Here, a thermostatically controlled injection valve 86 is partially included in the design of the cap 28 as diecast part and thus does not consume any own assembly space with its essential component outside the evaporator, as is still the case in the design as block valve 50 in FIG. 1.

Preferably, the housing 88 of the injection valve 86 is additionally formed by the diecast part of the cap 28.

The other components of the injection valve are formed of commercially available elements. Especially, in the neighborhood of the front side of the header 18 on the side of the inlet at the longitudinal side thereof, in the diecast part a thread 90 is left open, which is obtained in a finishing process by hollowing and into which an adjusting screw (setting screw) 94 can be screwed to various extents, at the same time sealing the circumference by an O-ring seal. This adjusting screw 94 forms with a cavity formed at the front side thereof a receiving space for the valve spring 96, which is retained at its internal side by a valve cage 98, which supports a spherical valve element 100 at its front side facing away from the valve spring, which valve element cooperates with a valve seat 102.

The valve element is biased by the valve spring 96 into a closed position of the valve opening 104 surrounded by the valve seat and controls the connecting cross-section between the supply line 14 and a mixer chamber 106, which is arranged upstream of the supply lines 44 of the inlet openings to the inlet chambers 36. In the diecast part, furthermore a guiding extension 108 is additionally embodied, which projects into the mixer chamber 106 with an inclination and has a distributing function to the individual supply lines 44. A baffle function is taken over by the throttle function at the injection valve.

Axially opposite the thread 90 in the diecast part a further thread 110 for receiving the thermohead 112 is left open, which communicates with the outlet chamber 34. For this purpose, the thermohead is connected via a stepped valve pin 114 with the spherical valve element 100, the valve pin having a clearance with respect to the internal opening of the thread 110, so that the flow connection between the outlet chamber 34 and the thermohead is guaranteed. Depending on the temperature of the exiting refrigerant of the outlet chamber 34 impinging on the thermohead, the injection valve is more or less opened, so that an adaptation to a constant temperature determined by the screwed in depth of the adjusting screw 94 is achieved.

The supply line 14 and the outlet line 16 comprise a common connection flange 116, which engages pocket or dead threads 120 at the outside of the diecast part via fastening screws 118.

What is claimed is:

1. A header of a heat exchanger for motor vehicles, comprising:

a tube bottom and a cap which together form a housing;

a chamber subdivision of intersecting flat webs wherein the chamber subdivision is an integral part which is inserted in the housing of the header; and pins configured to form a connection with the tube bottom or the cap wherein the pins start from junction points between the flat webs of the chamber subdivision with a housing wall or intersection points of the flat webs of the chamber subdivision.

2. A header according to claim 1, wherein at free edges of the chamber subdivision, pins are provided for the connection with the tube bottom as well as with the cap.

3. A header according to claim 2, wherein the pins for the connection with the tube bottom and the pins for the connection with the cap are aligned.

4. A header according to claim 1 wherein the pins at the chamber subdivision are arranged in a centric internesting into gaps of a raster of arrangement of flat tubes in the tube bottom.

5. A header according to claim 4, wherein the flat webs of the chamber subdivision are columnarily reinforced at the connection point of these pins.

6. A header according to claim 1, wherein the junction points between the flat webs of the chamber subdivision with the housing wall extending around and/or intersection points of flat webs of the chamber subdivision are designed in a columnar reinforcement.

7. A header according to claim 6, wherein the columnar reinforcements pass over into pins.

8. A header according to claim 1, wherein the pins are tapered.

9. A header according to claim 1, wherein the wall thickness of the flat webs of the chamber subdivision is in the region of 0.6 to 1.5 mm.

10. A header according to claim 1, wherein the cap or the tube bottom together with each housing wall extending therearound are an integral diecast part made of a solderable or brazable material.

11. A header according to claim 10, wherein the heights of the chamber subdivision and of the housing wall extending around are the same.

12. A header according to claim 10, wherein when making the cap as a diecast part, the tube bottom is shaped of a sheet metal piece and when making the tube bottom as a diecast part, the cap is shaped of a sheet metal piece.

13. A header according to claim 12, wherein the sheet metal is coated with solder or braze on at least one side.

14. A header according to claim 12, wherein the housing wall extending around the cap diecast part or the tube bottom diecast part engages the sheet metal piece with a positive fit.

15. A header according to claim 14, wherein:

the housing wall extending around the cap diecast part or the tube bottom diecast part engages a soldered or brazed connection layer of the sheet metal piece.

16. A header according to claim 14, wherein the housing wall extending around the cap diecast part or the tube bottom diecast part engages a collar extending around the sheet metal piece.

17. A header according to claim 14, wherein the housing wall extending around the ap diecast part or the tube bottom diecast part engages a groove extending around and formed by the sheet metal piece.

18. A header according to claim 10, wherein the wall thickness of the housing of the header is in the region of 1.0 to 2.0 mm.

19. A header according to claim 10, wherein the wall thickness of the housing of the header is in the region of 1.2 to 1.5 mm.

20. A header according to claim 1, wherein the tube bottom, the cap, or the chamber subdivision are made of an aluminum alloy comprising aluminum and 1.6% manganese, or an aluminum alloy comprising aluminum, 0.5% silicon and 1% magnesium.

21. A header according to claim 1, wherein:

the tube bottom, the cap, or the chamber subdivision are made of aluminum or aluminum alloy.

22. A header according to claim 1, wherein:

the chamber subdivision is a solderable or brazable material.

23. A header according to claim 1, wherein the wall thickness of the flat webs of the chamber subdivision is in the region of 1.0 to 1.3 mm.

24. A heat exchanger, comprising:

a header formed by a tube bottom and a cap;

intersecting flat webs separating a chamber in the header into a plurality of subchambers;

a plurality of flat tubes for providing a path between the subchambers; and pins configured to form a connection with the tube bottom or the cap, wherein the pins start from junction points between the flat webs with a header wall or intersection points of the flat webs.

25. A header for a heat exchanger, comprising:

a header chamber formed by at least a tube bottom and a cap;

a diecast longitudinal web separating the header chamber into at least an input chamber and an output chamber;

at least one diecast crosswise web formed integrally with the longitudinal web, separating the input chamber into a plurality of subchambers; and pins extending outwardly from either side of a columnar reinforcement located at an intersecting point of the longitudinal web and the crosswise web.

26. A header according to claim 25, wherein: the longitudinal web is a solderable or brazable material.

27. A header according to claim 25, wherein: a plurality of ducts couple the input chamber to the output chamber.

28. A header according to claim 27, further comprising: means for coupling a supply line to at least some of the plurality of ducts.

29. A header according to claim 27, further comprising: at least one additional longitudinal web, additionally separating the header into at least one inner reversion chamber between the input chamber and the output chamber, the reversion chamber coupling at least some of the plurality of ducts with one another.

30. A header according to claim 25, further comprising:

means for fastening the pins with the tube bottom or the cap.

31. A header according to claim 25, further comprising:

means for connecting the web with the tube bottom and the cap.

32. A method, comprising:

distributing a refrigerant from an input chamber of a heat exchanger header to at least one flat tube leading away from the heat exchanger header;

reversing the flow of the refrigerant into at least one other flat tube coupled to an output chamber of the heat exchanger header; and separating the refrigerant in the input chamber of the heat exchanger header from the refrigerant in the output chamber of the heat exchanger header with intersecting flat webs, the flat webs forming the input and output chambers by connecting with a tube bottom or cap with pins starting from junction points at intersections of the flat webs.

* * * * *